US008517320B1

(12) United States Patent
Nicely

(10) Patent No.: US 8,517,320 B1
(45) Date of Patent: Aug. 27, 2013

(54) QUICK ATTACHMENT BRACKET FOR SECURING A FIRST ITEM TO A SECOND ITEM

(76) Inventor: Charles W Nicely, Cherry Hill, NJ (US)

( * ) Notice: Subject to any disclaimer, the term of this patent is extended or adjusted under 35 U.S.C. 154(b) by 278 days.

(21) Appl. No.: 12/874,122

(22) Filed: Sep. 1, 2010

(51) Int. Cl.
*A47B 96/00* (2006.01)

(52) U.S. Cl.
USPC ..... 248/223.41; 248/220.21; 248/250; 248/301; 211/90.01

(58) Field of Classification Search
USPC ..... 248/223.41, 225.21, 225.11, 224.8, 248/220.21, 220.22, 250, 300, 301, 208, 248/236; 211/135, 90.01, 90.02; 40/661.03, 40/649; 280/33.99 A
See application file for complete search history.

(56) References Cited

U.S. PATENT DOCUMENTS

| | | | | |
|---|---|---|---|---|
| 2,835,503 | A * | 5/1958 | Humphries et al. | 280/47.19 |
| 3,084,463 | A * | 4/1963 | Reynolds et al. | 40/564 |
| 4,828,120 | A * | 5/1989 | Beil et al. | 211/88.01 |
| 6,189,248 | B1 * | 2/2001 | Nagel et al. | 40/661.03 |
| 6,220,461 | B1 * | 4/2001 | Dickinson | 211/90.01 |
| 6,264,220 | B1 * | 7/2001 | Pierce et al. | 280/79.3 |
| 6,367,752 | B1 * | 4/2002 | Forsythe et al. | 248/220.21 |
| 6,698,701 | B1 * | 3/2004 | Dalton | 248/222.12 |
| 6,712,324 | B2 * | 3/2004 | Catteau et al. | 248/222.51 |
| 6,837,383 | B1 * | 1/2005 | McElhaney, Jr. | 211/70.6 |
| 7,798,336 | B2 * | 9/2010 | Shiao | 211/70.6 |

* cited by examiner

*Primary Examiner* — Anita M King
(74) *Attorney, Agent, or Firm* — Daniel S. Polley

(57) ABSTRACT

A quick attachment bracket that permits a tool holder to be quickly secured to the sidewall of a cart is disclosed. The bracket snaps onto the cart and locks the tool holder in position without the use of any mechanical devices.

15 Claims, 5 Drawing Sheets

QUICK ATTACHMENT BRACKET FOR SECURING A FIRST ITEM TO A SECOND ITEM

FIELD OF THE INVENTION

The present invention relates generally to brackets and more particularly to a bracket for holding a first item to a second item, such as, but not limited to, a tool holder to a cart.

BACKGROUND OF THE INVENTION

The use of movable carts, such as, but not limited to, industrial strength carts for many industrial and commercial material handling applications, as well as, other handling application is known. In additional to moving materials, often a cart is used for also moving tools that may be needed for the particular function or application. The tools may be accumulated in a loose configuration within a toolbox or tool carrier or may be disposed loosely directly on one or more of the shelves of the cart. The use of tool organizers is also known for storing tools. However, separate means for transportation for the tool organizer or allowing for a portion of the available storage space on the cart shelf is required. Additionally, certain tool organizers are not constructed for disposing on a shelf and such use can cause the tools to become loose and fall out of the holder. Thus, the present invention quick attachment bracket overcomes these problems by permitting a tool holder to be quickly secured to the side of a cart shelf without using virtually any of the storage space provided by the shelf and also permitting use of the cart to transport the user's tools.

SUMMARY OF THE INVENTION

As referenced above, the present invention generally provides a quick attachment bracket that permits a tool holder to be quickly secured to the side or shelf of a cart, such as, but not limited, an industrial cart, without using virtually any of the storage space provided by the shelf. The quick attachment bracket also permits the cart to be used as the transport device for the user's tools and any other items being stored or housed on the shelf(s) of the cart. The bracket preferably snaps onto the cart and locks the tool holder in position without the use of any other mechanical fastening or securing devices.

Preferably, the cart shelf, or other item, has at least one wall member having a top edge and a lower edge. The body member of the bracket is configured to receive the top edge of the wall to which the bracket is intended to be secured. Once the top edge is received the bracket can be slightly rotated downward to permit one or more lower tabs of the bracket to form a snap relationship with the lower edge of the wall member. At this point, the bracket is securely locked to the wall member.

The bracket body member is provided within an opening or aperture, preferably a central opening, for receipt a portion of the tool holder. Prior to securing the present invention bracket body member to the side of the cart shelf, an insertion portion of the tool holder is inserted through the aperture and extends outward. The end of the tool holder which does not go through the bracket opening or aperture is provided with a perimeter flange which abuts the inner surface of the bracket surrounding the opening/aperture, such that when the bracket is secured to the cart shelf, the perimeter flange locks the tool holder in place and prevents the tool holder from being pulled through the aperture/opening of the bracket body member. Though the bracket is securely attached to the wall member, an amount of horizontal movement can still be permitted for the attached bracket with respect to the cart shelf. Preferably, though not considered limiting, the present invention bracket can be secured to the top shelf of a cart or industrial cart.

With the tool holder securely attached, the user has his or her tools neatly organized, ready for use and without occupying any of the storage space provided by the cart shelf. Though, the present invention is described above and below for use with a cart and/or tool holder it is not limited to such use only. Thus, the bracket of the present invention can be used for securing other items to each other and all other uses are also considered within the scope of the invention.

BRIEF DESCRIPTION OF THE INVENTION

Figures 1, 2:
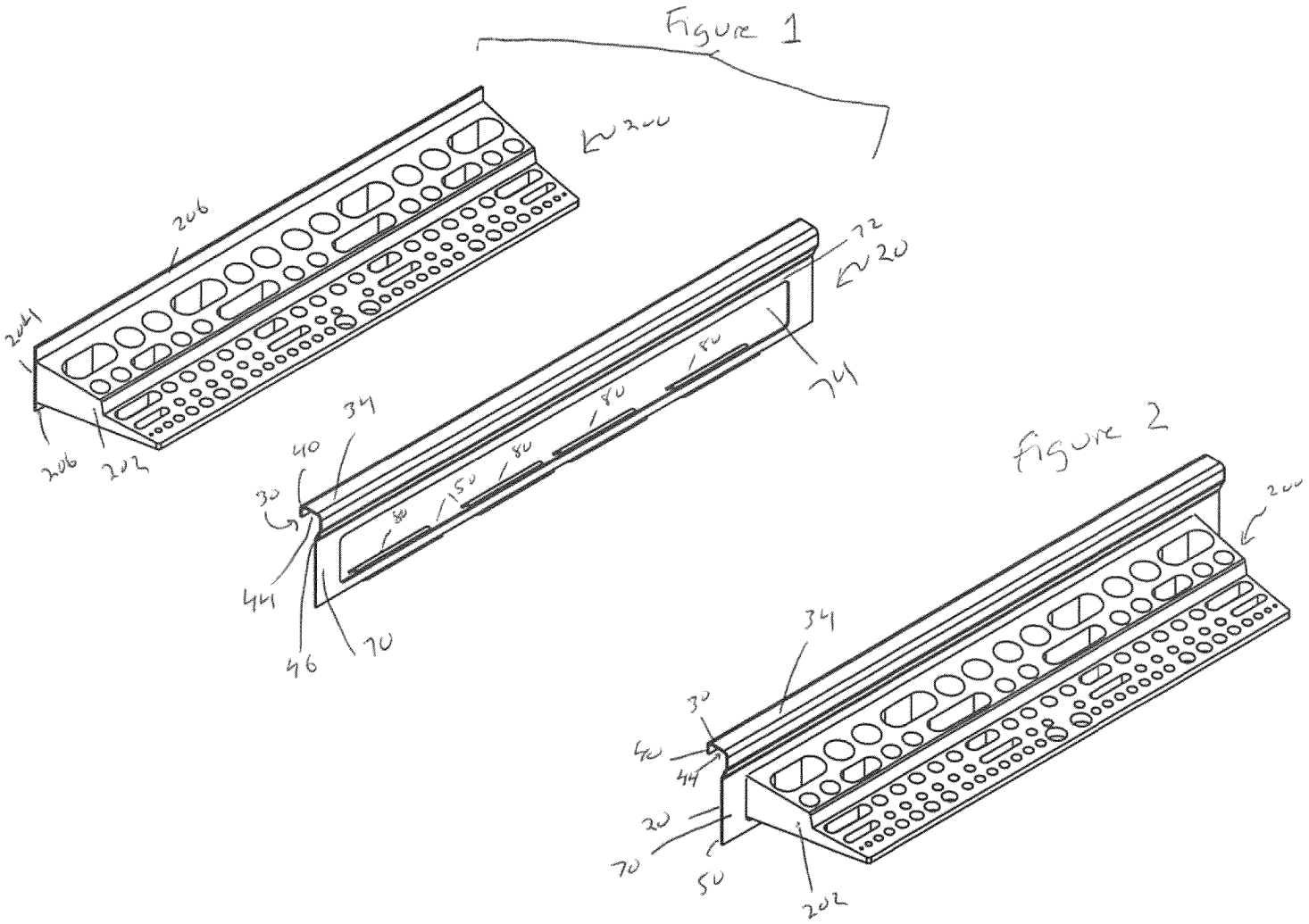
FIG. 1 illustrates a perspective view of the quick attachment bracket in accordance with the present invention and also showing a tool holder that can be used with the bracket in accordance with the present invention.
FIG. 2 illustrates the quick attachment bracket and the tool holder of FIG. 1 showing the position of the tool holder with respect to the bracket when the bracket is secured to a shelf, such as, but not limited to a cart shelf.
Figure 6:
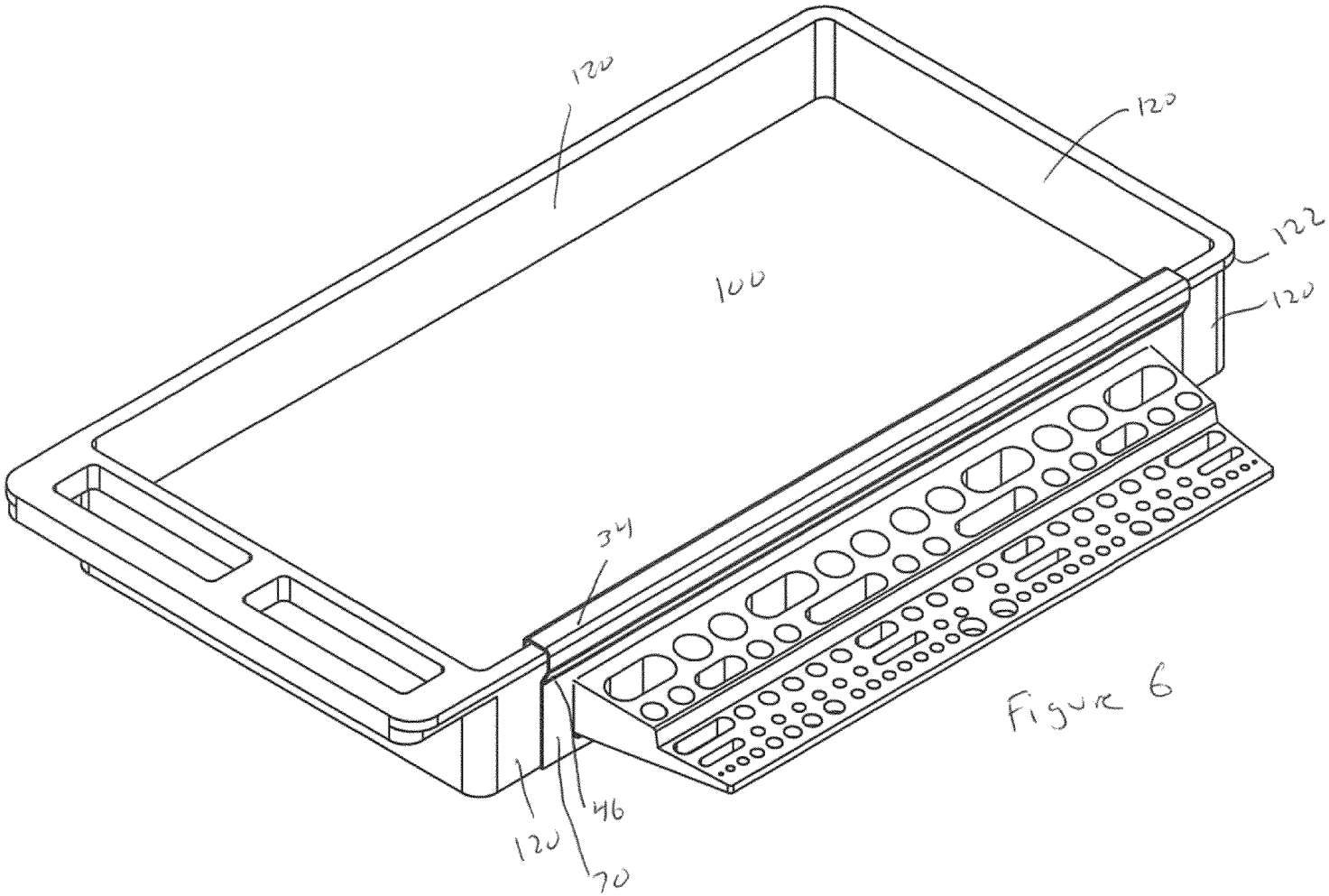
Figure 7:
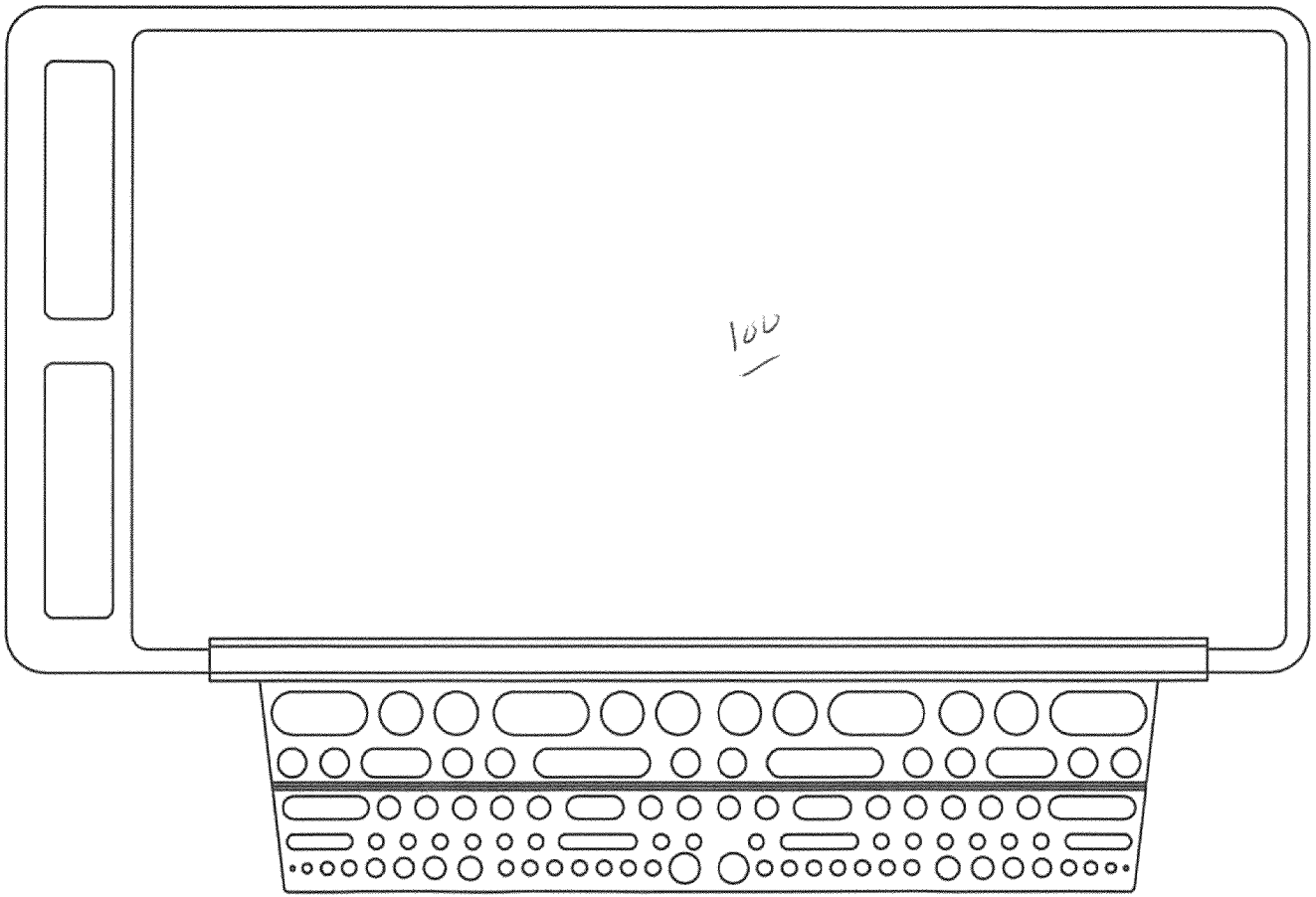
Figure 7:
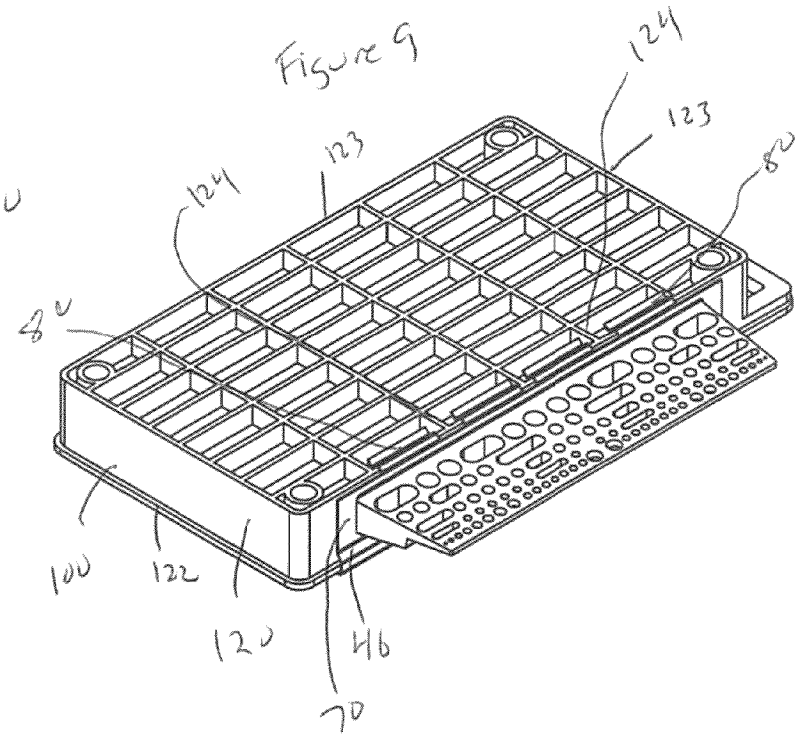
Figure 8:
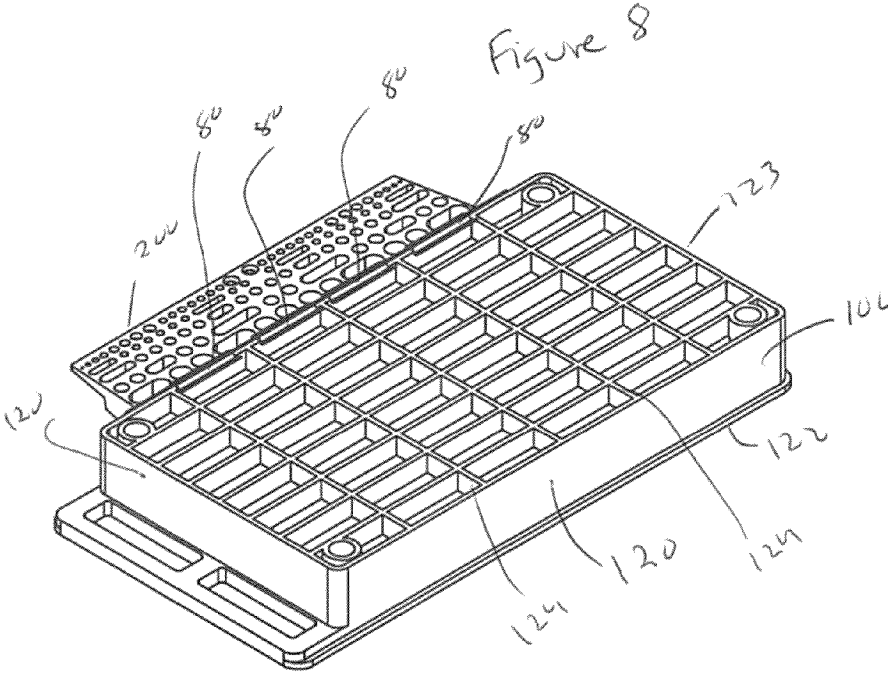

FIG. 6 a perspective view of the quick attachment bracket of FIG. 1 secured to the side of a cart shelf, which can be a top shelf, of a transportable industrial cart (though not limited to such), and also showing the quick attachment bracket securing the tool holder of FIG. 1;

FIG. 7 is a top view of the quick attachment bracket of FIG. 1 securing the tool holder of FIG. 1 to a cart shelf;

FIG. 8 is a first bottom perspective view of the quick attachment bracket of FIG. 1 securing the tool holder of FIG. 1 to a cart shelf; and FIG. 9 is a second bottom perspective view of the quick attachment bracket of FIG. 1 securing the tool holder of FIG. 1 to a cart shelf.

DETAILED DESCRIPTION OF THE PREFERRED EMBODIMENT

As seen in the Figures, a quick attachment bracket is disclosed and generally designated as bracket 20. Though not considered limiting, in one preferred embodiment, bracket 20 is secured to a cart shelf, such as the shelf 100 of an industrial cart. The cart is provided with at least one shelf 100, such as, which can be a top shelf for the cart (though not considered limiting) having a side wall 120. The top of side wall 120 can be provided with an outward extending lip 122. The bottom of side wall 120 can be provided with a lower edge 123, which be provided with lower support dividers 124.

Bracket 20 can be preferably constructed or monolithically formed as a one-piece bracket 20. Bracket 20 includes a body member 22 having top receiving end 30 and a lower locking end 50. A middle portion 70 is provided between top end 30 and lower end 50.

Top end 30 receives the top edge or portion of the item bracket 20 is intended to be secured to. As a non-limiting example, side wall 120 of cart 100 will be used as the item bracket 20 is secured to. As such, the top of side wall 120 having lip 122 is received within top end 30. Preferably, top end 30 includes a horizontal portion 34 having a first inner edge 36 and a second outer edge 38. A first downward extending portion 40 extends downward from first inner edge 36 and a second downward extending portion 42 extends downward from second outer edge 38. Horizontal portion 34, first downward portion 40 and second downward portion 42 define a receiving area 44, such as for receiving the top of side wall 120. Receiving area 44 can be substantially U-shaped in cross sectional shape though such is not considered limiting and the cross-sectional shape of receiving area 44, as well as its dimensions, can be determined by and correspond to the shape and dimensions of the top of sidewall 120 or the top of any other item that bracket 20 is intended to be attached to.

Though not considered limiting, the length between first inner edge 36 and second outer edge 38 can be determined by and can be preferably slightly longer than the length of the top end of side wall 120 from point A to point B. Similarly, the length of how far second portion 42 extends downward can be determined by and can be preferably slightly longer than length that the top of sidewall 120 extends downward.

In view of the upper lip created at the top of sidewall 120, extending downward from the bottom end of second portion 42 and also tapering inward is a third portion 46. The angular relationship can be anywhere between approximately 35 degrees and approximately 55 degrees and can include any subset range of numbers between these numbers and can be any number between and including the outer range numbers and all are considered incorporated by reference as set forth herein and within the scope of the invention.

Third portion 46 accounts for the upper lip and positions middle or intermediate portion 70 closer to the remaining portion of sidewall 120 underneath lip 122. Where no lip 122 or similar object is provided on the item that the bracket is to be secured to, than the inward configuration can be eliminated and second portion 42 can extend downward and run into middle portion 70.

In the preferred embodiment, middle portion 70 can be substantially rectangular in shape having a perimeter portion 72 which defines an opening 74 in middle portion where a portion of the tool holder 200 extends therethrough when tool holder 200 is secured to cart shelf 100 by bracket 20. Prior to securing bracket body member 22 to sidewall 120 of cart shelf 100, an insertion portion 202 of tool holder 200 is inserted through aperture or opening 74 and extends outward therefrom. End 204 of tool holder 200 which does not go through bracket opening 74 can be provided with a perimeter flange 206 which abuts the inner surface of perimeter portion 72 of bracket 20, such that when bracket 20 is secured to cart shelf 100, perimeter flange 206 of tool holder 200 locks tool holder 200 in place and prevents tool holder 200 from being pulled through aperture/opening 74 of bracket body member 22. Thus, in use tool holder perimeter flange 206 is disposed between bracket body member 22 and sidewall 120.

Figures 3, 4, 5:
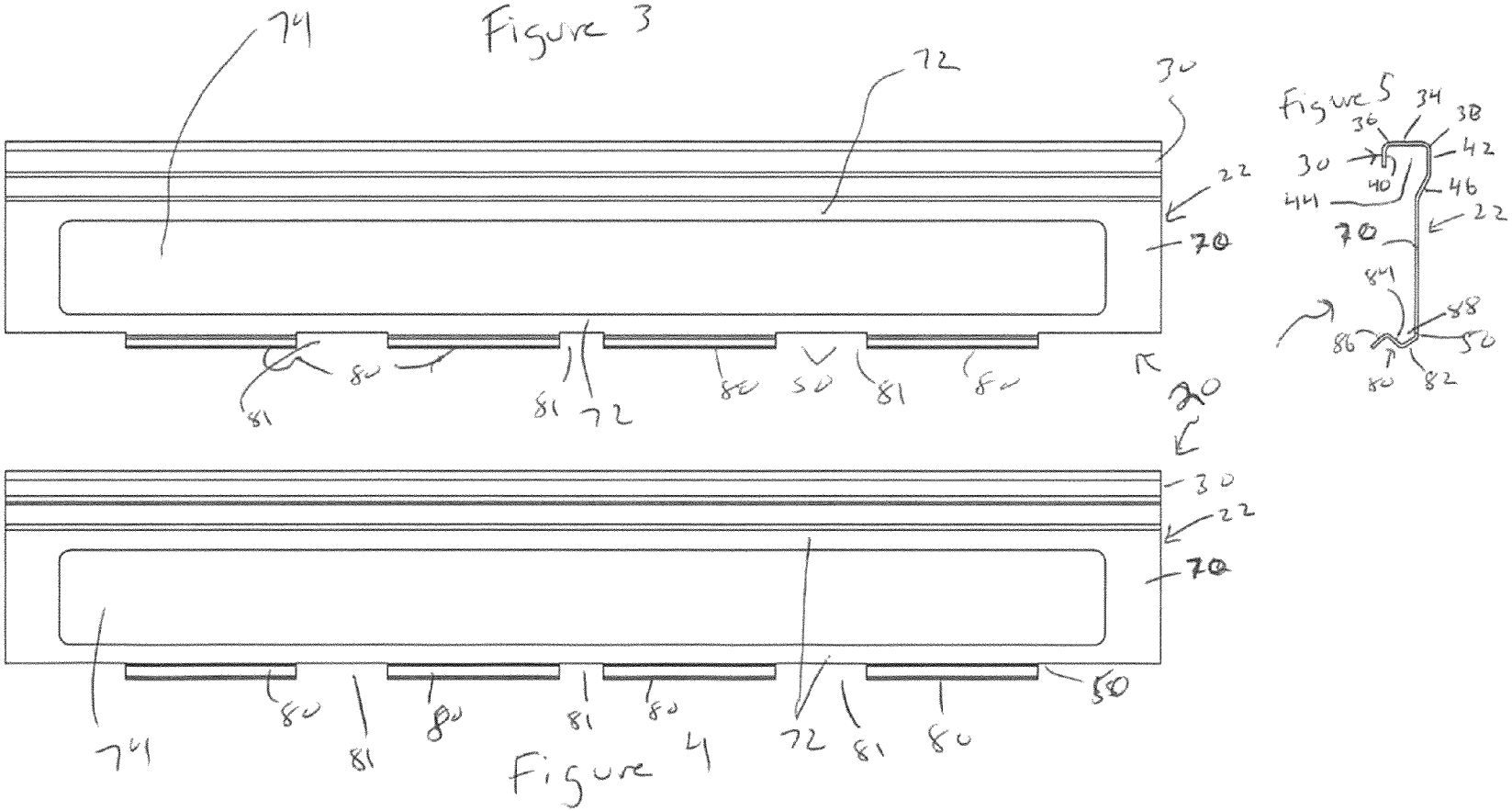
FIGS. 3, 4 and 5 illustrate front, back and side elevational views of the quick attachment bracket of FIG. 1.

At least one, and preferably a plurality of mounting, tabs 80 are secured to a lower edge or lower end of middle portion 70. Each mounting tab 80 preferably can be provided with a first member 82 (which can be substantially horizontal or angled with respect to middle portion 70 and shown in FIG. 5 more angled) and which can preferably slightly taper downward from the lower end of middle portion 70, a upwardly extending second member 84 which can slightly taper upward and outward with respect to first member 82, and a third member 86 (which can be substantially horizontal or angled with respect to middle portion 70) and which can slightly taper downward from the top of second member 84. A receiving area 88 can be defined between a lower part of middle portion 70, first member 82 and second member 84 for receipt of a lower portion of the item that bracket 20 is to be secured to, such as, but not limited to, the lower end of cart sidewall 120. Third member 86 can preferably act as a release grip or handle when detaching bracket 20 from its secured attachment to the first item (i.e. sidewall 120).

Preferably a plurality of mounting tabs 80 are secured along the lower end of middle portion 70. The space or gap 81 between adjacent mounting tabs 80 provides an area for receiving an outermost portion of a lower support divider 124 of the cart shelf. The lower support divider 124 acts as a stop member and limits the amount of horizontal movement bracket 20 can travel while secured to sidewall 120.

In use, to secure bracket 20 (having portion 202 of tool holder 200 inserted through bracket opening 74) to shelf 100 of a cart (i.e. industrial cart, etc.), the top end of sidewall 120 is inserted within top receiving end 30 of bracket 20. Bracket 20 is rotated slightly downward which causes the lower edge 123 of sidewall 120 to be receiving within the receiving areas 88 and the sidewall divider supports 124 to be disposed within corresponding or associated gaps 81. At this point, bracket 20 and tool holder 200 are safely secured to sidewall 120, with the insertion portion of tool holder extending outward from shelf 100 and capable of receiving and neatly storing and organizing one or more tools, while not consuming any of the storage spaced defined by shelf 100. The securement of bracket 20 to shelf 100 is strong enough to support tool holder 200 and the weight of the tools (not shown).

To quickly disconnect bracket 20 from sidewall 120, the user grabs one or more of the release members 86 and pulls such release member which causes the lower edge 123 of sidewall 120 to no longer be disposed within receiving area 88. This in turn, permits bracket 20 to slightly rotate outward and permitting the upper end of sidewall 120 to be removed out of receiving area 44.

Thus, bracket 20 quickly snaps on to side edge or sidewall of cart 10 and locks tool holder 200 into position without the use of any mechanical or fastening devices.

Bracket 20 is not considered limited to any specific material. In one non-limiting embodiment, bracket 20 can be constructed from aluminum, steel or other metal, such as but not limited to, corrosion resistant steel, though such is not considered limiting and other materials can be used and are considered within the scope of the invention. Shelf 100 and/or tool holder 120 can be constructed from plastic, though such is not considered limiting and other materials can be used and are considered within the scope of the invention.

All measurements, amounts, values, ranges, degrees, percentages, materials, orientations, etc. discussed above or shown in the drawing figures are merely by way of example and are not considered limiting and other measurements, amounts, values, ranges, degrees, percentages, materials, orientations etc. can be chosen and used and all are considered within the scope of the invention.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A bracket for securing a first item to a second item, said bracket comprising:

a one piece body member having an upper receiving area, an intermediate portion and a lower area, said intermediate portion defining an opening therein;

wherein said upper receiving area adapted to receive an upper portion of a cart shelf and said lower area adapted for aiding in maintaining securement of the bracket to the cart shelf;

wherein a tool holder receiving area is defined when said bracket is secured to the cart shelf between the cart shelf and the bracket which is adapted for receipt and retaining of a portion of a tool holder which causes the tool holder to be secured to the cart shelf;

wherein said bracket permits said tool holder to be secured to said cart shelf;

wherein said upper receiving area comprising a substantially U-shaped member and said lower area comprising a plurality of tabs;

wherein said upper receiving area further comprising a first section extending downwardly and tapering inward from one end of said substantially U-shaped member and terminating into said intermediate portion such that said intermediate portion is positioned inward underneath an upper lip of said cart shelf.

2. The bracket of claim 1 wherein each of said tabs having a gripping member extending outward from an outer end of said tab.

3. A bracket for securing a first item to a second item, said bracket comprising:

a body member having an upper receiving area comprising a substantially U-shaped member, an intermediate portion, a first section extending downwardly and tapering inward from one end of said substantially U-shaped member and terminating into said intermediate portion at an upper edge of said intermediate portion and a plurality of tabs secured to a lower edge of said intermediate portion, said intermediate portion defining an opening therein, each of said plurality of tabs defining a lower area;

wherein said upper substantially U-shaped member adapted to receive an upper portion of a first item and said plurality of tabs adapted for aiding in maintaining securement of the bracket to the first item;

wherein a second item receiving area is defined when said bracket is secured to the first item between the first item and the bracket which is adapted for receipt and retaining of a portion of the second item which causes said second item to be secured to said first item.

4. The bracket of claim 3 wherein each of said tabs having a gripping member extending outward from an outer end of said tab.

5. A bracket for securing a first item to a second item, said bracket comprising:

a one piece body member having an upper receiving area comprising a substantially U-shaped member, an intermediate portion and a plurality tabs secured to a lower edge of said intermediate portion, said intermediate portion defining an opening therein, each of said plurality of tabs defining a lower area;

wherein said upper substantially U-shaped member adapted to receive an upper portion of a cart shelf and said tabs adapted for maintaining securement of the bracket to the cart shelf;

wherein a tool holder receiving area is defined when said bracket is secured to the cart shelf between the cart shelf and the bracket which is adapted for receipt and retaining of a portion of the tool holder which causes said tool holder to be secured to said cart shelf;

wherein said bracket permits said tool holder to be secured to said cart shelf;

wherein said upper receiving area further comprising a first section extending downwardly and tapering inward from one end of said substantially U-shaped member and terminating into said intermediate portion such that said intermediate portion is positioned inward underneath an upper lip of said cart shelf.

6. A bracket for securing a first item to a second it said bracket comprising:

an elongated one piece body member having an upper receiving area, an intermediate portion and a plurality mounting tabs secured to a lower edge of said intermediate portion, said intermediate portion defining an opening therein, each of said plurality of mounting tabs defining a lower receiving area;

wherein said upper receiving area comprising:

a first section extending substantially downwardly;

a second section extending outward from said first section and secured to said first section in a substantially perpendicular relationship;

a third section extending downward from an outer end of said second section and secured to said second section in a substantially perpendicular relationship; wherein said first section, said second section and said third section define a substantially U-shaped upper receiving area; and a fourth section extending downward and tapering inward from a lower edge of said third section and secured to said third section in an angular relationship at a first edge of said fourth section and secured to said intermediate portion at a second edge of said fourth section;

wherein said substantially U-shaped member receiving area adapted to receive an upper portion of a first item and said mounting tabs adapted for receiving a lower portion of the first item in order to secure the bracket to the first item;

wherein a second item receiving area is defined when said bracket is secured to the first item between the first item and a lower section of the intermediate portion which is adapted for receipt and retaining of a portion of the second item which causes said second item to be secured to said first item.

7. The bracket of claim 6 wherein said bracket permits a tool holder to be secured to a sidewall of a cart shelf.

8. The bracket of claim 7 wherein said fourth section positioning said intermediate portion underneath an upper lip of said cart shelf when said elongated body member is secured to the cart shelf.

9. The bracket of claim 7 wherein said elongated body member is secured to said cart shelf without the use of any mechanical or fastening devices.

10. The bracket of claim 6 wherein each of said mounting tabs having a gripping member extending outward from said mounting tab receiving area.

11. The bracket of claim 6 wherein said angular relationship is between approximately 35 degrees to approximately 55 degrees.

12. The bracket of claim 6 wherein said angular relationship is approximately 45 degrees.

13. The bracket of claim 6 wherein upper receiving area, said intermediate portion and said plurality of mounting tabs are monolithically formed as a one piece bracket.

14. A bracket for securing a first item to a second item, said bracket comprising:

a body member having an upper receiving area, an intermediate portion and a lower area, said intermediate portion defining an opening therein;

wherein said upper receiving area comprising a substantially U-shaped member adapted to receive an upper portion of a first item and said lower area adapted for aiding in maintaining securement of the bracket to the first item;

wherein a second item receiving area is defined when said bracket is secured to the first item between the first item and the bracket which is adapted for receipt and retaining of a portion of the second item which causes said second item to be secured to said first item;

wherein when said bracket is secured to the first item a portion of said upper receiving area is above the upper portion of the first item and a portion of the lower area is below the lower portion of the first item;

wherein said upper receiving area further comprising a first section extending downwardly and tapering inward from one end of said substantially U-shaped member and terminating into said intermediate portion.

15. The bracket of claim 14 wherein said lower area comprising a plurality of tabs which are adapted for aiding in maintaining securement of the bracket to the first item.

* * * * *